US007049755B2

(12) United States Patent
Kosaka

(10) Patent No.: US 7,049,755 B2
(45) Date of Patent: May 23, 2006

(54) METHOD FOR DRIVING PLASMA DISPLAY PANEL

(75) Inventor: Tadayoshi Kosaka, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/999,076

(22) Filed: Nov. 30, 2004

(65) Prior Publication Data

US 2006/0007065 A1 Jan. 12, 2006

(30) Foreign Application Priority Data

Jul. 6, 2004 (JP) ..... 2004-199757

(51) Int. Cl.
*G09G 3/10* (2006.01)

(52) U.S. Cl. ..... 315/169.4; 315/169.1; 315/169.2; 345/48; 345/55; 345/95; 345/212

(58) Field of Classification Search .. 315/169.1–169.4; 345/41, 42, 48, 51–53, 55, 60, 66–68, 90, 345/94, 95, 98–100, 211–214
See application file for complete search history.

(56) References Cited

U.S. PATENT DOCUMENTS 6,630,796 B1 * 10/2003 Tokunaga et al. ..... 315/169.4
6,686,912 B1 * 2/2004 Kishi et al. ..... 345/211
6,753,833 B1 * 6/2004 Seo et al. ..... 345/60
6,856,305 B1 * 2/2005 Nagano ..... 345/60
6,937,213 B1 * 8/2005 Iwasa et al. ..... 345/60

FOREIGN PATENT DOCUMENTS

JP 2002-116730 4/2002

* cited by examiner

*Primary Examiner*—Haissa Philogene
(74) *Attorney, Agent, or Firm*—Staas & Halsey LLP

(57) ABSTRACT

A plasma display panel (PDP) includes a first plurality of electrodes, a second plurality of electrodes paired with the first plurality of respective electrodes, and a third plurality of electrodes. The PDP further includes a plurality of cells at crossing portions between the first and second pluralities of electrodes and the third plurality of electrodes. In the PDP, a method comprises driving a PDP for displaying a picture on the PDP by dividing a field into a plurality of subfields, and resetting for adjusting charges in the cells in the subfields. The resetting for adjusting charges comprises applying voltage waveforms to the electrodes so that the potential difference applied between the second plurality of electrodes and at least one of the first plurality of electrodes and the third plurality of electrodes for the resetting for adjusting charges in a predetermined one of the subfields is larger than the potential difference applied therebetween for the resetting for adjusting charges in a previous subfield.

5 Claims, 10 Drawing Sheets

METHOD FOR DRIVING PLASMA DISPLAY PANEL

FIELD OF THE INVENTION

The present invention relates generally to driving of a plasma display panel (PDP), and more particularly to application of a resetting voltage during subfields.

BACKGROUND ART

A PDP includes a plurality of parallel linear scanning electrodes for scanning and discharging for display, a plurality of parallel linear sustaining electrodes for discharging for display that are arranged between the scanning electrodes, and a plurality of parallel linear addressing electrodes crossing orthogonally the scanning and sustaining electrodes, for providing data to be displayed. Display cells are formed in areas where these electrodes cross each other. Each of these electrodes is covered with dielectric. Discharge at each cell is controlled in accordance with the amount of the wall charge formed on the dielectric. In the interlaced scanning scheme, one frame, which corresponds to an interval for displaying one picture, consists of two fields of an even-numbered field and an odd-numbered field, and one field consists of about eight to fifteen subfields. In the progressive scanning scheme, one frame consists of one field, and a subfield may be referred to also as "sub-frame". Each subfield contains a reset period of time, an address period of time, and a sustain period of time which has a variable length. The reset period is a period of time for resetting the state of wall charges of cells varied in the previous subfield. During the address period, a voltage is selectively applied to the addressing electrodes in accordance with the subfield data while scanning pulses are applied sequentially to the respective scanning electrodes, to thereby vary the state of the wall charges of the cells, so that the cells are selectively activated. During the sustain period, the cells selected and activated during the address period are discharged for display.

Setoguchi et al., in Japanese Unexamined Patent Publication JP 2002-116730 (A) laid open on Apr. 19, 2002, disclose a method for driving a plasma display panel, in which, in each subfield of a field, the difference between an addressing voltage applied to first electrodes and an addressing voltage applied to second electrodes during an address period is controlled to be larger than the difference between a resetting voltage applied to the first electrodes and a resetting voltage applied to the second electrodes during a reset period.

In order to initialize or equalize voltages developed by the wall charges in the cells, typically, a larger resetting pulse voltage is applied between scanning electrodes and sustaining electrodes, or alternatively a larger ramping voltage is applied between them, and then a smaller ramping voltage is applied between them. The known $V_t$ closed curve represents thresholds for discharging in cells of a PDP in association with the relationship among the cell voltage $Vc_{XY}$ representative of the sum of the voltage difference applied between the sustaining electrodes X's and the scanning electrodes Y's, and the wall voltage developed between the electrodes X's and Y's, and the cell voltage $Vc_{AY}$ representative of the sum of the voltage difference applied between the addressing electrodes A's and the scanning electrodes Y's, and the wall voltage developed between the electrodes A's and Y's. The $V_t$ closed curve is described in detail in Japanese Unexamined Patent Publication JP 2003-248455 (A), which is incorporated by reference herein in its entirety.

SUMMARY OF THE INVENTION

In accordance with an aspect of the present invention, a method in a PDP comprises driving the PDP for displaying a picture on the PDP by dividing a field into a plurality of subfields. The PDP has a first plurality of electrodes arranged in a first direction, a second plurality of electrodes paired with the first plurality of respective electrodes and arranged in the first direction, and a third plurality of electrodes arranged in a second direction so as to cross over the first direction. The PDP has a plurality of cells at crossing portions between the first and second pluralities of electrodes and the third plurality of electrodes. The method further comprises resetting for adjusting charges in the cells in the subfields. The resetting for adjusting charges comprises applying voltage waveforms to the electrodes so that the potential difference applied between the second plurality of electrodes and at least one of the first plurality of electrodes and the third plurality of electrodes for the resetting for adjusting charges in a predetermined one of the subfields is larger than the potential difference applied therebetween for the resetting for adjusting charges in a previous subfield.

In accordance with another aspect of the invention, the resetting comprises producing discharge for forming charges in the cells in a predetermined subfield within a plurality of fields before producing discharge for adjusting the charges in the cells.

DESCRIPTION OF THE PREFERRED EMBODIMENTS

Figure 1:
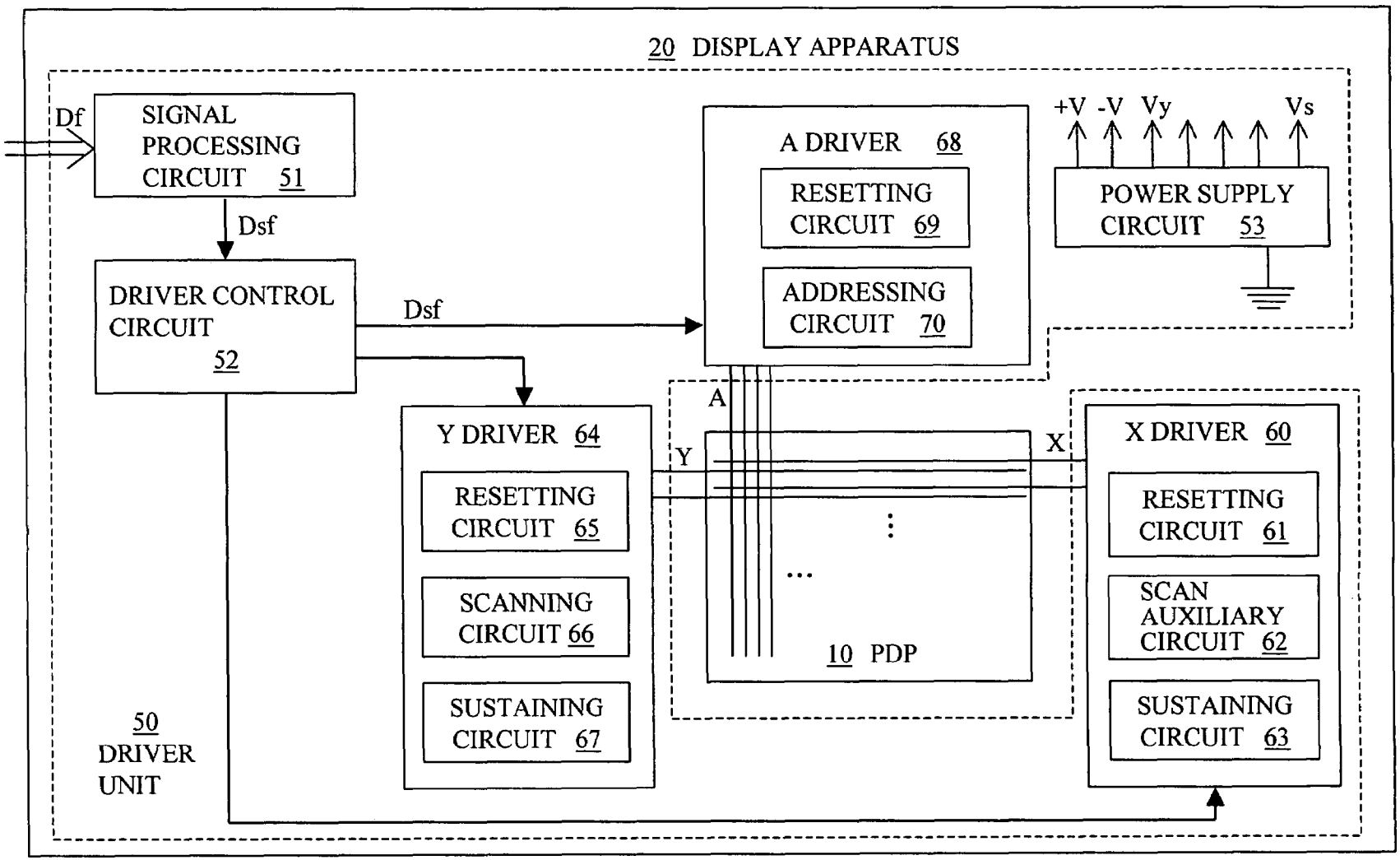
FIG. 1 shows a schematic arrangement of a display apparatus for use in an embodiment of the present invention.

Despite the description in Japanese Unexamined Patent Publication JP 2002-116730 (A), in practice, dispersion of the effective voltages for the different cells may be caused by the wall charges developed under the influence of their adjacent cells or by the structural differences among the cells. In Japanese Unexamined Patent Publication JP 2002-116730 (A), such dispersion of the effective voltages for the cells is not taken into consideration, and hence failure of discharging may occur depending on the extent of the dispersion of the effective cell voltages even if the technique is used to control the addressing voltage difference to be larger than the resetting voltage difference, as described in Japanese Unexamined Patent Publication JP 2002-119630 (A).

Discharge or light emission does not occur in a cell, when the cell voltage representative of the sum of the wall voltage of the cell and the externally applied voltage difference varies and moves to a point of coordinates located inside the Vt closed curve. On the other hand, discharge occurs in the cell, when the cell voltage moves to a point of coordinates located outside the Vt closed curve. The wall voltage of the cell moves toward and is located on the Vt closed curve, when a ramping voltage is applied between the electrodes. The wall voltage of the cell moves toward the coordinate origin, when a pulse voltage is applied between the electrodes. In each subfield, the wall voltages after application of the ramping, resetting voltage, and the wall voltage during application of the addressing voltage ideally should not vary in one subfield after another, and should be located at the corner on the Vt closed curve in the first quadrant. In practice, however, after the wall voltage of an cell which has not been illuminated previously is reset, the wall voltage may move to the point of coordinates inside the Vt closed curve. That is so because the state of the wall voltage may be varied under the influence of the illuminated cells adjacent to the unilluminated cell in the last several subfields, especially the last, eighth subfield. Thus, for the last several subfields, especially the last, eighth subfield, the electrodes of the cell may fail to produce discharge during the address period, and hence the cell may fail to emit light during the subsequent sustain period.

In a conventional PDP, discharge to be produced by applying address pulses is facilitated by, for example, expanding the width of the address pulses. However, this may not be sufficient. Furthermore, in this case, the address period is also expanded, so that the time length to be designated for the sustain period is reduced, and hence the peak or maximum brightness of the PDP is reduced.

The inventor has recognized that the wall voltage on the displaying electrodes of a cell can be prevented from entering the inside of the Vt closed curve by gradually raising the voltage difference applied between the displaying electrodes in one reset period to another for one subfield after another.

An object of the present invention is to provide a higher quality of displaying for a PDP.

Another object of the invention is to provide higher reliability of cell discharge during an address period and a sustain period of the subsequent subfield of a field.

According to the invention, the reliability of the cell discharge can be raised even during an address period and a sustain period of a subsequent subfield of a field.

The invention will be described with reference to the accompanying drawings. Throughout the drawings, similar symbols and numerals indicate similar items and functions.

FIG. 1 shows a schematic arrangement of a display apparatus 20 for use in an embodiment of the present invention. The display apparatus 20 includes a plasma display panel (PDP) 10 of the tree-electrode surface discharge structure type having a display screen with an array of n×m cells, and a driver unit 50, as enclosed in the dashed line in the figure, for selectively controlling the cells to emit light. The display apparatus 20 is applicable to, for example, a television receiver, a monitor display of a computer system, and the like.

In the PDP 10, pairs of displaying electrodes X1, Y1, X2, Y2, . . . , Xn, and Yn, which generate discharges for displaying, are arranged in parallel to each other, and addressing electrodes A1 to Am are arranged such that the addressing electrodes A1 to Am cross the displaying electrodes X1, Y1, X2, Y2, . . . , Xn, and Yn. The displaying electrodes X1 to Xn represent sustaining electrodes, and the displaying electrodes Y1 to Yn represent scanning electrodes. The displaying electrodes X1 to Xn, and Y1 to Yn typically extend in the row or horizontal direction of the display screen, and the addressing electrodes A1 to An extend in the column or vertical direction.

The driver unit 50 includes a signal processing circuit 51, a driver control circuit 52, a power supply circuit 53, an X electrode driver circuit or X driver circuit 60, a Y electrode driver circuit or Y driver circuit 64, and an addressing electrode driver circuit or A driver circuit 68 for controlling the potentials of selected ones of the addressing electrodes in accordance with data for display. The driver unit 50 is implemented in the form of an integrated circuit, which may possibly contain an ROM. A field of data Df representative of the magnitudes of emission for the three primary colors of R, G and B is provided together with various synchronized signals to the driver unit 50 from an external device, such as a TV tuner or a computer. The field data Df is temporarily stored in a field memory of the signal processing circuit 51. The signal processing circuit 51 converts the field data Df into subfields of data Dsf for displaying in gradation, and provides the subfield data Dsf via the driver control circuit 52 to the A driver circuit 68. The subfield data Dsf is a set of display data associating one bit with each cell, and the value for each bit represents whether or not each cell should emit light during the corresponding one subfield SF.

The X driver circuit 60 includes a resetting circuit 61 for applying a voltage for initialization to the displaying electrodes X's to equalize the wall voltages in a plurality of cells forming the display screen of the PDP 10, a scan auxiliary circuit 62 for applying a predetermined voltage to the sustaining electrodes during the addres period, and a sustaining circuit 63 for applying sustaining pulses to the displaying electrodes X's to cause the cells to produce discharge for displaying. Depending on the designed voltage waveforms during the reset period and the address period, the functions of the resetting circuit 61 and the scan auxiliary circuit 62 may be incorporated into the sustaining circuit 63, while the resetting circuit 61 and the scan auxiliary circuit 62 are eliminated. The Y driver circuit 64 includes a resetting circuit 65 for applying a voltage for initialization to the displaying electrodes Y's, a scanning circuit 66 for applying scanning pulses to the displaying electrodes Y's for addressing, and a sustaining circuit 67 for applying sustaining pulses to the displaying electrodes Y's to cause cells to produce discharge for displaying. The A driver circuit 68 includes a resetting circuit 69 for applying a predetermined flat voltage to the addressing electrodes A's during the initialization period, and an addressing circuit 70 for applying address pulses to the addressing electrodes A's designated in the subfield data Dsf. Depending on the designed voltage waveform during the reset period, the function of the resetting circuit 69 may be incorporated into the addressing circuit 70, while the resetting circuit 69 is eliminated.

The driver control circuit 52 controls the application of the pulses, and the transfer of the subfield data Dsf. The power supply circuit 53 supplies driving power to desired portions of the unit.

Figure 2:
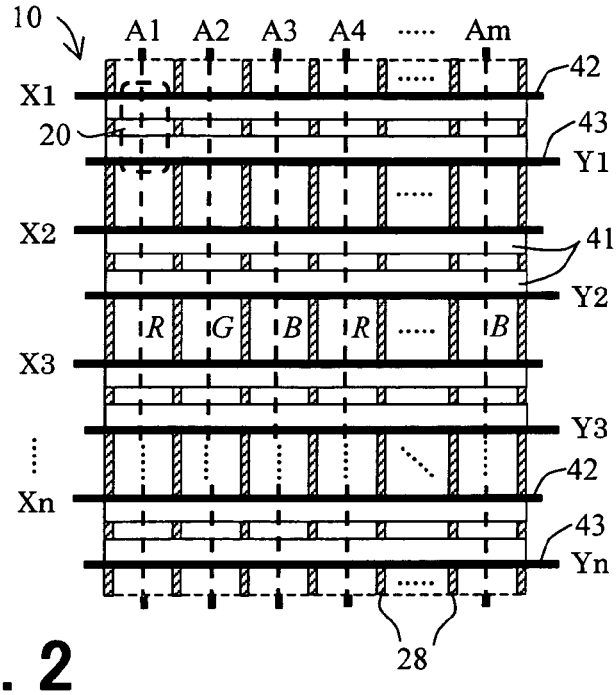
FIG. 2 shows an arrangement of the cells in a straight-cell structure of the PDP, in the embodiment of the invention.

FIG. 2 shows an arrangement of the cells in a straight-cell structure of the PDP 10 used in the embodiment of the invention. In the PDP 10, the pairs of displaying electrodes (X1, Y1) to (Xn, Yn) are arranged for the respective cells in each row of the display screen which has n rows and m columns on the inner surface of a front glass substrate. The displaying electrodes X1 to Xn, and Y1 to Yn are formed by transparent conductive films 41 forming a gap for surface discharge, and bus electrodes 42 and 43 made of metal films overlaid on the edge portions of the transparent conductive films 41. The combination of the transparent conductive films 41 and the bus electrodes 42 and 43A are covered with a dielectric layer and a protection layer. m columns of addressing electrodes A1 to Am are arranged on the inner surface of a rear glass substrate, and these addressing electrodes A1 to An are covered with a dielectric layer. Ribs or separating walls 28 partitioning the discharge spaces for the respective columns are provided on the dielectric layer. The ribs 28 shown in FIG. 2 are arranged in a pattern of stripes. However, the pattern may be, for example, a box pattern or a grid-like pattern. A phosphor layer for color display, which covers the front surface of the dielectric layer and the inner side surfaces of the ribs 28, is locally excited by a UV ray radiated by a discharge gas of the cell, and emits visible light. The italics R, G and B in the figure indicate the colors of the emitted lights of the phosphors. The arrangement of the colors has a repeated pattern of R, G and B, in which the cells in each column exhibit the same color.

One picture typically has one frame period of approximately 16.7 ms. One frame consists of two fields in the interlaced scanning scheme, and one frame consists of one field in the progressive scanning scheme. In displaying on the PDP 10, for reproducing colors by the binary control of light emission, one field F in the time domain, representative of an input image of one such field period of approximately 16.7 ms, is typically divided into a predetermined number, q (e.g., q=8), of subfields SF's. Typically, each field F is replaced with a set of q subfields SF's. Often, the number of times of discharging for display for each subfield SF is set by weighting these subfields SF's with respective weighting factors of $2^0$, $2^1$, $2^2$, . . . , $2^{q-1}$ in this order. However, the weighting factors to be associated with the subfields SF's are not limited to the powers of two, as described above. N ($=1+2^1+2^2+ \ldots +2^{q-1}$) steps of brightness can be provided for each color of R, G and B in one field by associating light emission or non-emission with each of the subfields in combination. In accordance with such a field structure, a field period Tf, which represents a cycle of transferring field data, is divided into q subfield periods Tsf's, and the subfield periods Tsf's are associated with respective subfields SF's of data. Furthermore, a subfield period Tsf is divided into a reset period TR for initialization, an address period TA for addressing, and a display or sustain period TS for emitting light. Typically, the lengths of the reset period TR and the address period TA are constant independently of the weighting factors for the brightness, while the number of pulses in the display period becomes larger as the weighting factor becomes larger, and the length of the display period TS becomes longer as the weighting factor becomes larger. In this case, the length of the subfield period Tsf becomes longer, as the weighting factor of the corresponding subfield SF becomes larger. However, the lengths of the reset period TR and the address period TA are not limited to those described above, and these lengths may be different for each subfield. The length of the displaying period TS is not limited to that described above, and is not required to become longer as the weighting factor becomes larger.

Figure 3:
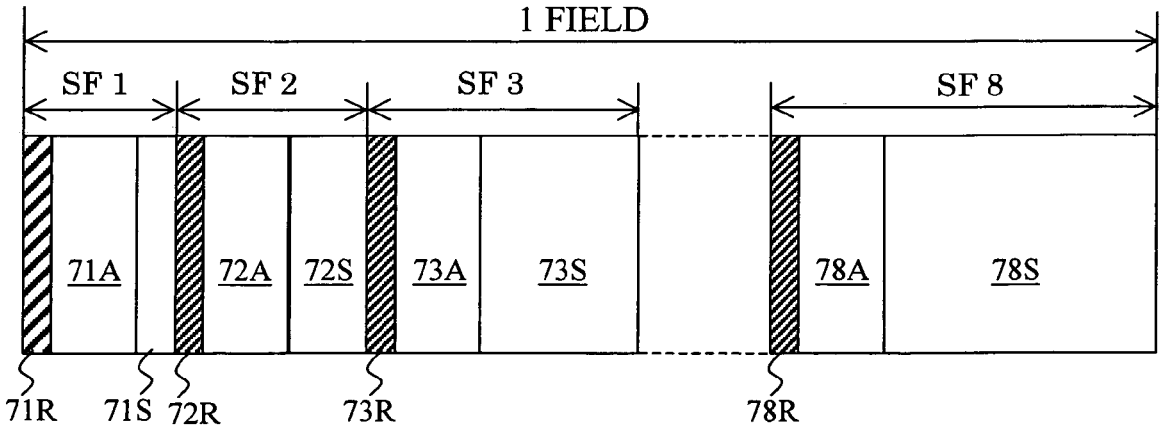
FIG. 3 shows a structure of a field containing eight subfields as an example.

FIG. 3 shows the structure of a field containing eight subfields as an example. A first subfield SF1 contains a reset period 71R for major resetting, an address period 71A and a sustain period 71S. A second to an eighth subfields SF2 to SF8 contain respective reset periods 72R to 78R for minor resetting, respective address periods 72A to 78A, and respective sustain periods 72S to 78S.

Figure 4:
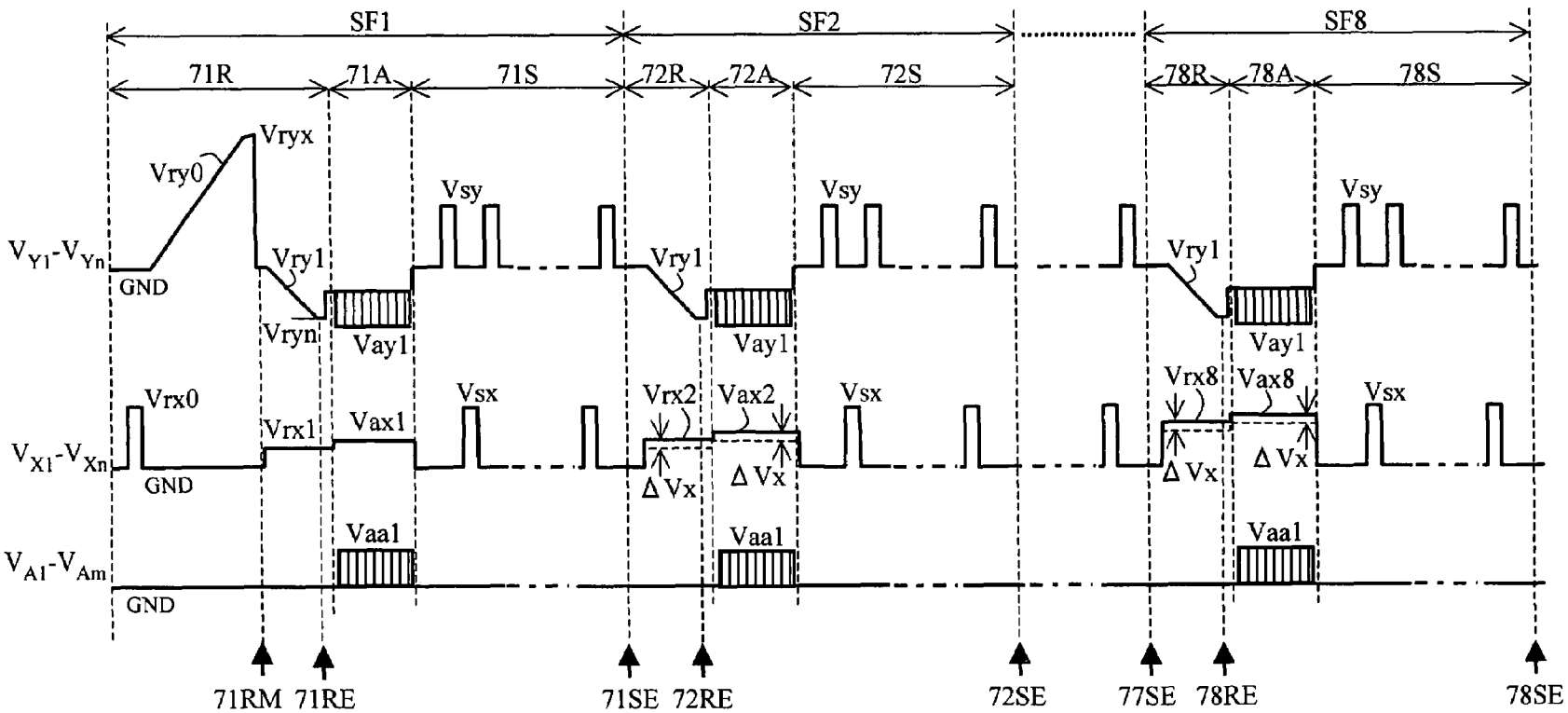
FIG. 4 shows a time sequence of the PDP driving voltages during the reset periods and the address periods of the respective subfields, in accordance with the first embodiment of the present invention.

FIG. 4 shows a time sequence of the driving voltages $V_{Y1}$ to $V_{Yn}$, $V_{X1}$ to $V_{Xn}$, and $V_{A1}$ to $V_{Am}$ for the displaying electrodes X1 to Xn, and Y1 to Yn, and the addressing electrodes A1 to Am, during the reset periods 71R to 78R and the address periods 71A to 78A of the respective subfields SF1 to SF8, in accordance with the first embodiment of the present invention.

In this specification, a term "major resetting" represents a combination of resetting discharge for accumulating charge during an interval between the starting time and a time 71RM during a reset period 71R as shown, and subsequent resetting for adjusting the charge during an interval between the time 71RM and a time 71RE. In addition, in this specification, a term "minor resetting" represents resetting for only adjusting the charge, and corresponds to an interval between the time 71RM and the time 71RE, and to each of the reset periods 72R, 73R and the like in the second and other subsequent subfields.

If all of the subfields would have respective reset periods for accumulating charge (similar to the interval between the starting time and the time 71RM, for SF1) and the reset period for adjusting the charge (similar to the interval between the time 71RM and the time 71RE), there would be a problem that the background illumination (the brightness for an input a value of zero (0)) would become larger. Thus, in the embodiment, the time sequence is arranged so that only the first subfield of a field has the reset interval for accumulating charge and the subsequent reset interval for adjusting the charge, and the other subfields have only the reset intervals for adjusting the charge.

Figure 7:
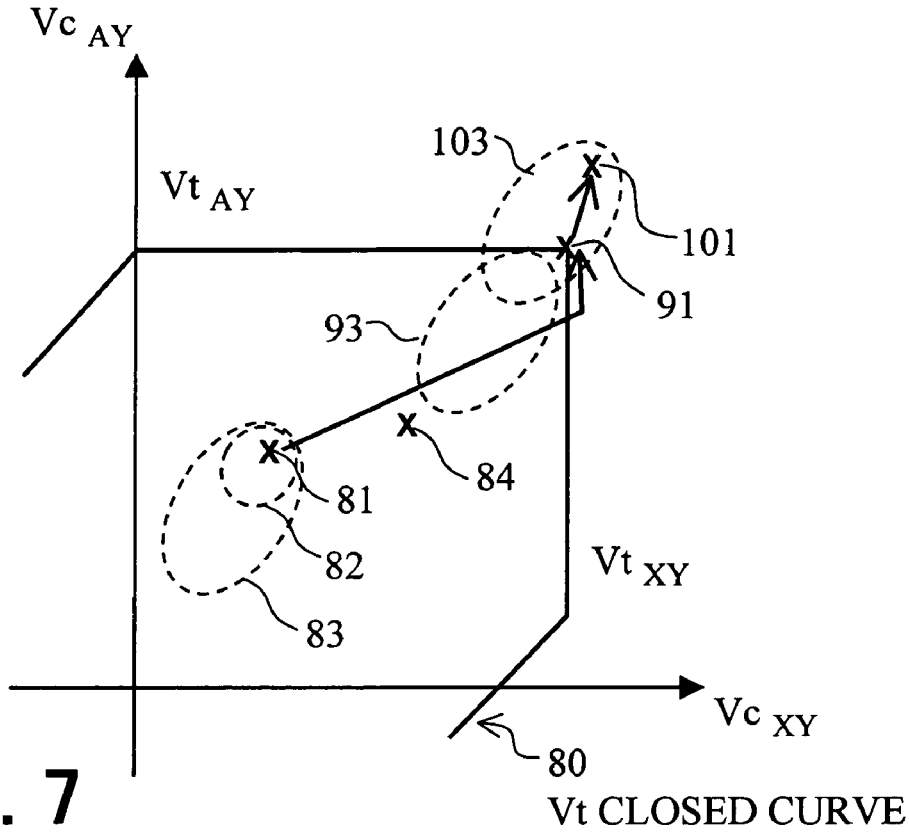
FIG. 7 shows the Vt closed curve and variations of the cell voltages, in accordance with the first embodiment.

FIG. 7 shows the Vt closed curve 80 and variations of the cell voltages, in accordance with the first embodiment. In FIG. 7, the Vt closed curve 80 represents threshold values for discharging in association with the relationship between a difference voltage $Vc_{XY}$ along the abscissa between the voltages at the displaying electrode X and at the displaying electrode Y, and a difference voltage $Vc_{AY}$ along the ordinate between the voltages at the addressing electrode A and at the displaying electrode Y.

In the embodiment, in the first subfield SF1 as shown in FIG. 4, a positive resetting pulse voltage Vrx0 (e.g., 160V) is applied to the displaying electrodes X1 to Xn by the resetting circuit 61, in a conventional manner, during a first portion of the major reset period 71R. During this portion, the displaying electrodes Y1 to Yn are kept by the resetting circuit 65 at a common conductor or ground potential GND (e.g., 0V). Subsequently, during a second portion of the reset period 71R, a first higher up-ramping, resetting voltage Vry0 in the positive direction having the maximum voltage Vryx (e.g., 400V) is applied to the displaying electrodes Y1 to Yn by the resetting circuit 65. During this portion, the displaying electrodes X1 to Xn are kept by the resetting circuit 61 at the ground potential GND. Subsequently, during a third portion of the reset period 71R, a negative second down-ramping voltage Vry1 having the minimum Vryn (e.g., −100V) is applied to the displaying electrodes Y1 to Yn by the resetting circuit 65, while a positive potential Vrx1 (e.g., 50V) is applied to the displaying electrodes X1 to Xn by the resetting circuit 61. During the reset period 71R, the addressing electrodes A1 to Am are kept at the ground potential GND (0V) by the resetting circuit 69.

During the address period 71A, in a conventional manner, the scanning circuit 66 applies a scanning pulse voltage Vay1 (e.g., −110V) to the displaying electrodes Y1 to Yn one after another, and it applies a predetermined voltage (e.g., −40V) to them while they are not scanned. On the other hand, the addressing circuit 70 applies an addressing voltage Vaa1 (e.g., 70V) to the selected addressing electrodes A1 to Am one after another in accordance with the subfield data Dsf. During this period 71A, the displaying electrodes X1 to Xn are kept at a potential Vax1 (e.g., 60V) by the scan auxiliary circuit 62.

During the sustain period 71S, in a conventional manner, sustaining pulse voltages Vsx and Vsy (e.g., 160V) are applied alternately to the displaying electrodes X1 to Xn, and Y1 to Yn by the sustaining circuits 63 and 67. During this period 71S, the addressing electrodes A1 to Am are kept at the ground potential GND by the A driver 68.

During a minor reset period 72R of the second subfield SF2, the resetting circuit 65 of the Y driver circuit 64 applies a negative down-ramping, resetting voltage Vry1 in the negative direction to the displaying electrodes Y1 to Yn, similarly to the second ramping, resetting voltage Vry1 during the reset period 71R, and the resetting circuit 61 of the X driver circuit 60 applies a predetermined voltage Vrx2 in the positive direction to the displaying electrodes X1 to Xn. The voltage Vrx2 is higher by a predetermined voltage ΔVx (e.g., 10V) than the voltage Vrx1 during the address period 71R of the subfield SF1. During this period 72R, the addressing electrodes A1 to Am are kept at the ground potential GND by the resetting circuit 69.

During the address period 72A, in a conventional manner, the scanning circuit 66 applies a scanning pulse voltage Vay1 one after another and otherwise a non-scanning potential to the displaying electrodes Y1 to Yn, while the address circuit 70 applies the addressing voltage Vaa1 to the addressing electrodes A1 to Am one after another in accordance with the subfield data Dsf. During this period 72A, the displaying electrodes X1 to Xn are kept at a predetermined potential Vax2 in the positive direction by the scan auxiliary circuit 62. The potential Vax2 is higher by the predetermined voltage difference ΔVx than the voltage Vax1 during the address period 71A. The potential at the last portion of the reset period becomes a reference potential for the subsequent scanning pulses, and hence the potential during the address period must be changed by the predetermined voltage difference ΔVx.

During the sustain period 72S, similarly to the sustain period 71S, in a conventional manner, the sustaining pulse voltages Vsx and Vsy are applied alternately to the X and Y electrodes, and the addressing electrodes A1 to Am are kept at the ground potential GND.

Similarly, during each of the reset periods 73R to 78R and the address periods 73A to 78A of the third to the eighth subfields SF3 to SF8, the resetting circuit 61 of the X driver circuit 60 applies a predetermined potential in the positive direction to the displaying electrodes X1 to Xn. The predetermined potential is higher by the predetermined voltage difference ΔVx than the voltage during the reset period and the address period of the previous subfield. Thus, during the reset period 78R and the address period 78A, predetermined potentials Vrx8 and Vax8 in the positive direction, that are higher by the predetermined voltage difference ΔVx than those in the previous subfield, are applied to the displaying electrodes X1 to Xn. During the third to the eighth subfields SF3 to SF8, other voltages to be applied to the displaying electrodes X1 to Xn, and Y1 to Yn are the same as those for the subfield SF2, and hence are not described again.

Referring back to FIG. 7, by applying the first and second ramping, resetting voltages Vry0 and Vry1 during the major reset period 71R of the first subfield SF1, the cell voltages ($Vc_{XY}$, $Vc_{AY}$) of all the cells are controlled to lie on the Vt closed curve 80 at the corner 91 of coordinates in the first quadrant, at the instant 71RE when the down-ramping pulse potential Vry1 at the displaying electrodes Y1 to Yn becomes the negative minimum potential Vryn. The cell voltages ($Vc_{XY}$, $Vc_{AY}$) of the cells selected during the address period 71A move to a point of coordinates 101 located outside the Vt closed curve 80 to thereby produce stable addressing discharge.

After that, when the voltage 0V is applied to all the electrodes at the time 71SE, which is the end of the sustain period 71S of the first subfield SF1, the cell voltages ($Vc_{XY}$, $Vc_{AY}$) of the previously unilluminanted cells are ideally located at the point of coordinates 81 located inside the Vt closed curve 80. In practice, however, it is located in a scattered form in the range of an area 82 which is closer to the coordinate origin by approximately 1 (one) to 20 volts, depending on the circumstances affected by the previously illuminated cells around the previously unilluminanted cells during the sustain period 71S.

During the reset period 72R of the second subfield SF2, a potential difference (Vrx2−Vry1) having the maximum potential difference, which is larger than the potential difference (Vrx1−Vryn) at the time 71RE which is the last portion of the reset period 71R, is applied between the displaying electrodes X1 to Xn and the displaying electrodes Y1 to Yn. Thus, the potential Vrx2 that is higher than the potential Vrx1 by the difference ΔVx is applied to the displaying electrodes X1 to Xn, so that the cell voltages ($Vc_{XY}$, $Vc_{AY}$) of the previously unilluminanted cell during the sustain period of the previous field reach the Vt closed curve 80 in the direction of the arrow from a position inside the area 82, and then move upward along the Vt closed curve 80 repeating micro-discharges, and then securely reach the corner of coordinates 91. Thereby, the dispersion of the cell voltages is absorbed. Thus, the cell voltages ($Vc_{XY}$, $Vc_{AY}$) of all the cells move to the corner of coordinates 91. The cell voltages of the cells selected in the subsequent address period 72A move to the point of coordinates 101, so that a stable address discharge is produced. Thus, the selected cells are illuminated securely during the sustain period. The cell voltages of the unselected cells move into the vicinity of the predetermined point of coordinates 81 in the range of the area 82 at the end of the next sustain period 72S. Similar operations develop for the third to eighth subfields SF3 to SF8.

The cell voltages ($Vc_{XY}$, $Vc_{AY}$) of the previously illuminated cell at the times 71RE to 78RE (when all the electrodes are set at 0V), which are the ends of the sustain periods 71S to 78S of the subfields SF1 to SF8, are located at the point of coordinates 84 inside the Vt closed curve 80. During the reset periods 72R to 78R of the subfields SF2 to SF8, the cell voltages reach the corner of coordinates 91, regardless of applying the present invention. On the other hand, in accordance with the present invention, the cell voltages of all of the previously illuminated and unilluminanted cells move securely to the corner of coordinates 91 of the Vt closed curve 80 during the reset periods 72R to 78R, regardless of the dispersion of the cell voltages at the times 71SE to 78SE which are the ends of the sustain periods 71S to 78S.

On the other hand, in a conventional PDP driver circuit without using the present invention, during the reset periods in SF2 to SF8, the potentials, which are equal to those in applying the second down-ramping resetting voltage in the reset period in SF1, are applied to the displaying electrodes Y1 to Yn, and X1 to Xn, and the addressing electrodes A1 to Am. Thus, the cell voltages at scattered positions within the area 82 may not reach the corner of coordinates 91. In this case, the cells selected during the address periods 72A to 78A produce addressing discharges at the scattered coordinate positions in the vicinity of the point of coordinates 101, and the dispersion of the cell voltages of the unselected cells remains and lingers in the subsequent subfield. When an unselected state of a cell continues over a plurality of subfields, the dispersion is accumulated for the subsequent subfields. At the end of the sustain period, especially the sustain period 77S in the seventh subfield SF7, the dispersion of the cell voltages spread to the range of 7V to 140V as shown in the area 83. The cell voltages at the time 78RE, which is the last portion of the reset period 78R in the subsequent eighth subfield SF8, are in the range shown as the area 93. In this case, the cell voltages of the selected cells during the addressing operation tend to disperse in the range shown in the area 103. Then discharge is not produced in the cell, the cell voltages of which are located inside the Vt closed curve, and hence the cell is not illuminated during the sustain period 78S.

Figure 5:
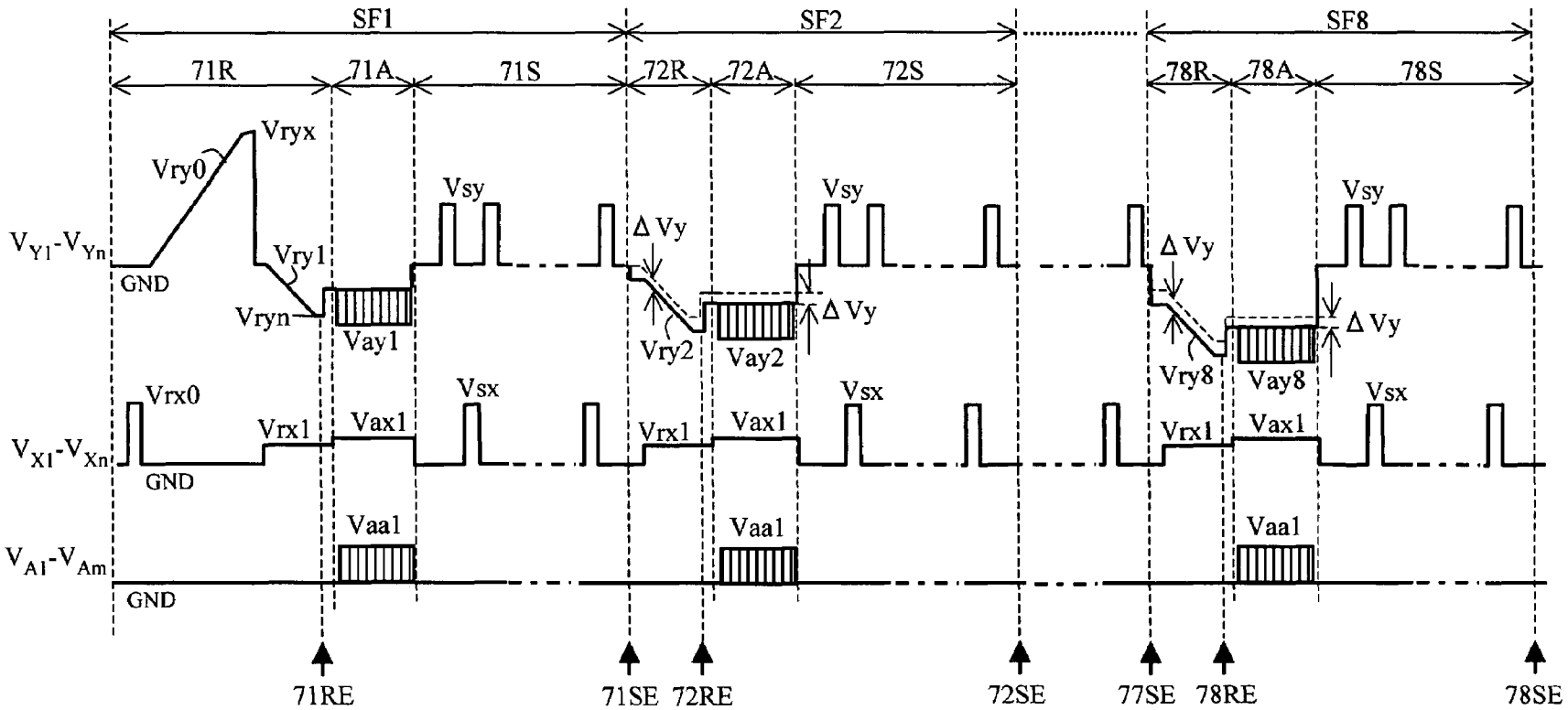
FIG. 5 shows a time sequence of the PDP driving voltages during the reset periods and the address periods of the respective subfields, in accordance with a second embodiment of the invention.

FIG. 5 shows a time sequence of the driving voltages $V_{Y1}$ to $V_{Yn}$, $V_{X1}$ to $V_{Xn}$, and $V_{A1}$ to $V_{Am}$ for the displaying electrodes X1 to Xn, and Y1 to Yn, and the addressing electrodes A1 to An, during the reset periods 71R to 78R and the address periods 71A to 78A of the respective subfields SF1 to SF8, in accordance with a second embodiment of the invention.

Figure 8:
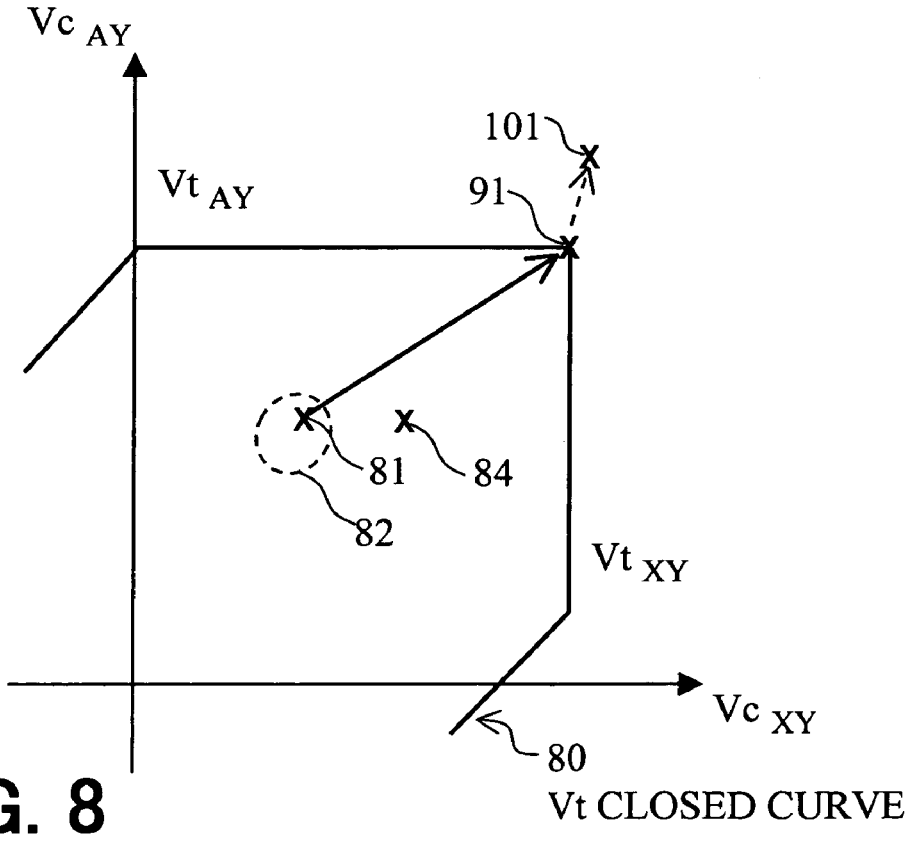
FIG. 8 shows the Vt closed curve and variations of the cell voltages, in accordance with the second embodiment.

FIG. 8 shows the Vt closed curve 80 and the variations of the cell voltages, in accordance with the second embodiment.

In the embodiment, as shown in FIG. 5, the driving voltages $V_{Y1}$ to $V_{Yn}$, $V_{X1}$ to $V_{Xn}$, and $V_{A1}$ to $V_{Am}$ for the first subfield SF1 are the same as those shown in FIG. 4.

During the minor reset period 72R of the second subfield SF2, the resetting circuit 65 of the Y driver circuit 64 applies, to the displaying electrodes Y1 to Yn, a negative down-ramping, resetting voltage Vry2 in the negative direction that is lower by a difference ΔVy (e.g., −10V) than the second ramping, resetting voltage Vry1 during the reset period 71R, and also the resetting circuit 61 of the X driver circuit 60 applies, to the discharging electrodes X1 to Xn, the predetermined voltage Vrx1 in the positive direction, similarly to that during the address period 71R of the subfield SF1. During this period 72R, the addressing electrodes A1 to Am are kept at the ground potential GND by the resetting circuit 69.

During the address period 72A, the scanning circuit 66 applies, to the displaying electrodes Y1 to Yn one after another, the scanning pulse voltage Vay1 in the negative direction and a non-scanning potential, that are lower by the difference ΔVy than the scanning pulse voltage Vay2 and the non-scanning potential during the address period 71A, while the address circuit 70, in the conventional manner, applies the addressing voltage Vaa1 to the addressing electrodes A1 to Am one after another in accordance with the subfield data Dsf. During this period 72A, the displaying electrodes X1 to Xn are kept at the potential Vax1 similarly during the address period 71A by the scan auxiliary circuit 62.

During the sustain period 72S, similarly to the sustain period 71S, in the conventional manner, the sustaining pulse voltages Vsx and Vsy are applied alternately to the X electrodes and the Y electrodes, and the addressing electrodes A1 to Am are kept at the ground potential GND.

Similarly, during each of the reset periods 73R to 78R and the address periods 73A to 78A of the third to eighth subfields SF3 to SF8, respectively, the resetting circuit 65 and the scanning circuit 66 of the Y driver circuit 64 apply, to the displaying electrodes Y1 to Yn, predetermined voltages in the negative direction that are lower by the predetermined voltage difference ΔVy than those during the reset period and the address period of the previous subfield. Thus, during the reset period 78R and the address period 78A, they apply, to the displaying electrodes Y1 to Yn, a predetermined ramping, resetting voltage Vry8 in the negative direction and a scanning pulse voltage Vay8 that are lower by the predetermined voltage difference ΔVy than those in the previous subfield. In the third to eighth subfields SF3 to SF8, other voltages to be applied to the displaying electrodes X1 to Xn, and Y1 to Yn are the same as those of the subfield SF2, and hence are not described again.

Referring to FIG. 8, during the reset period 72R of the second subfield SF2, by applying the potential differences (Vrx1−Vry2) and (0−Vry2) having the respective maximum potential differences larger than the potential differences (Vrx1−Vryn) and (0−Vryn) at the time 71RE which is the last portion of the reset period 71R, respectively, between the displaying electrodes X1 to Xn and the displaying electrodes Y1 to Yn, and between the addressing electrodes A1 to Am and the displaying electrodes Y1 to Yn, i.e., by applying the potential Vry2 to the displaying electrodes Y1 to Yn, the cell voltages ($Vc_{XY}$, $Vc_{AY}$) of the cells previously unilluminated during the sustain period of the previous field moves securely along the arrow toward the corner of coordinates 91 of the Vt closed curve 80 from a position located inside the area 82. Thereby, the dispersion of the cell voltages is absorbed. In practice, the cell voltages ($Vc_{XY}$, $Vc_{AY}$) cross slightly over the Vt closed curve and produce micro-discharges to thereby move to the corner of coordinates 91. Thus, the cell voltages ($Vc_{XY}$, $Vc_{AY}$) of all of the cells move to the corner of coordinates 91. The cell voltages of the cell selected during the subsequent address period 72A move to the point of coordinates 101, to produce stable address discharge. Thus, the cell is securely illuminated during the subsequent sustain period. The cell voltages of the unselected cells move into the vicinity of the predetermined point of coordinates 81 at the end of the next sustain period 72S, and then the cell voltages lie in the range of the area 82. Similar operations develop for the third to eighth subfields SF3 to SF8.

Figure 6:
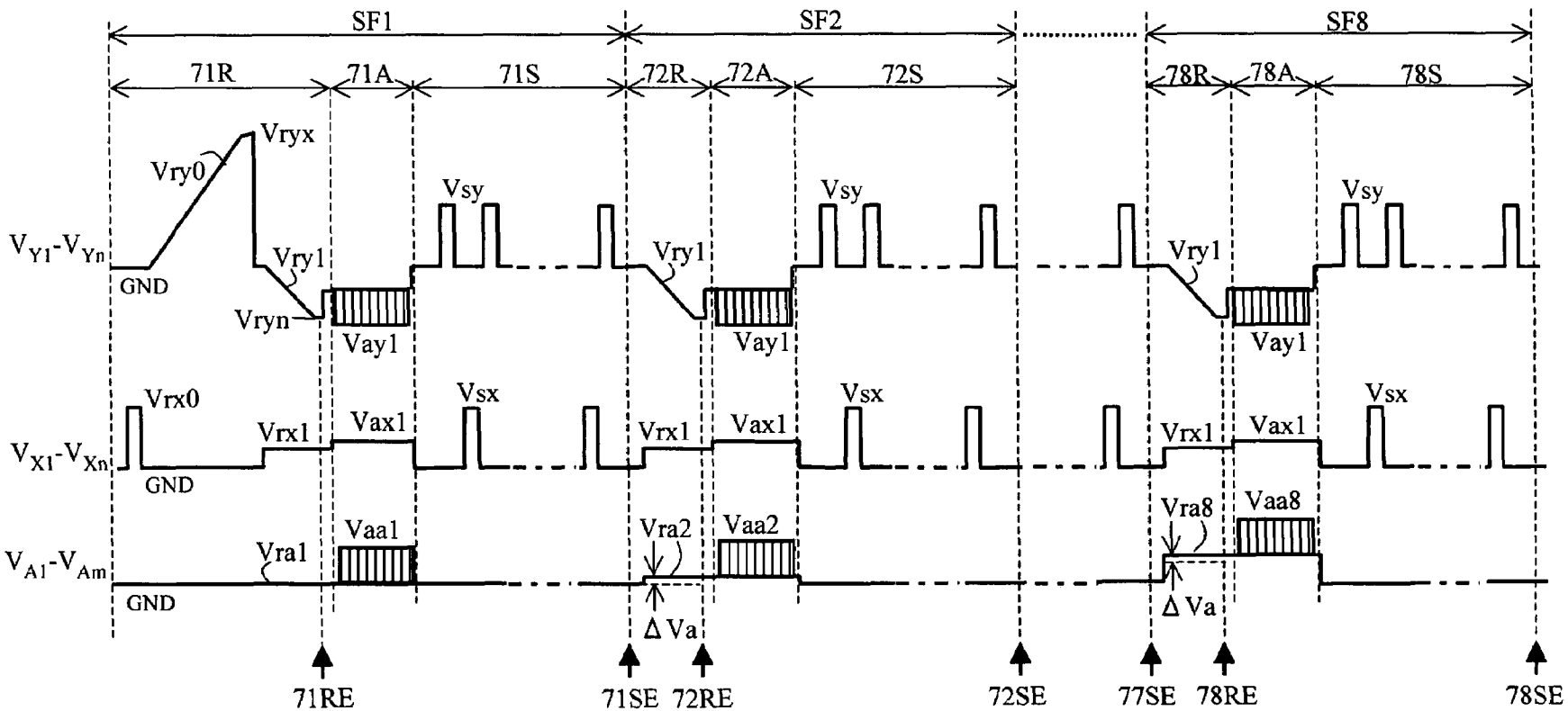
FIG. 6 shows the time sequence of the PDP driving voltages during the reset periods and the address periods of the respective subfields, in accordance with a third embodiment of the invention.

FIG. 6 shows the time sequence of the driving voltages $V_{Y1}$ to $V_{Yn}$, $V_{X1}$ to $V_{Xn}$, and $V_{A1}$ to $V_{Am}$ for the displaying electrodes X1 to Xn, and Y1 to Yn, and the addressing electrodes A1 to Am, during the reset periods 71R to 78R and the address periods 71A to 78A of the respective subfields SF1 to SF8, in accordance with a third embodiment of the invention.

Figure 9:
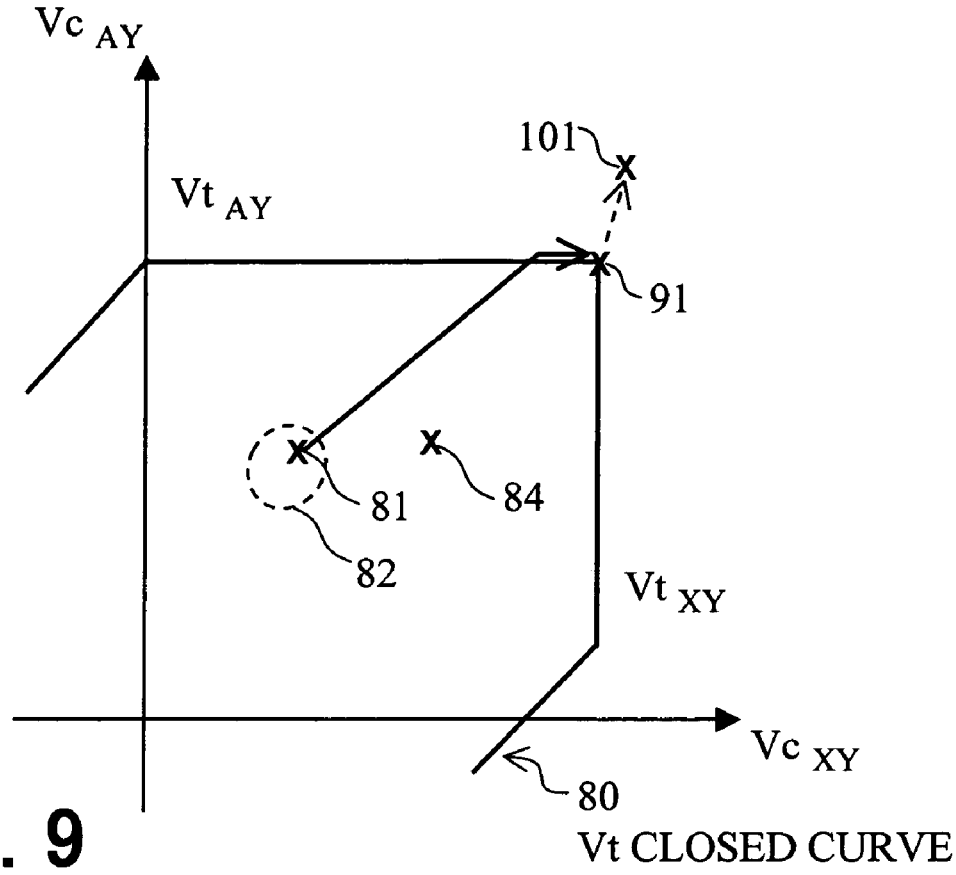
FIG. 9 shows the Vt closed curve and variations of the cell voltages, in accordance with the third embodiment.

FIG. 9 shows the Vt closed curve 80 and the variations of the cell voltages, in accordance with the third embodiment.

In the embodiment, as shown in FIG. 6, the driving voltages $V_{Y1}$ to $V_{Yn}$, $V_{X1}$ to $V_{Xn}$, and $V_{A1}$ to $V_{Am}$ are the same as those shown in FIG. 4.

During the minor reset period 72R of the second subfield SF2, in a conventional manner, the resetting circuit 65 of the Y driver circuit 64 applies, to the displaying electrodes Y1 to Yn, the ramping, resetting voltage Vry1 in the negative direction similarly to the second ramping, resetting voltage Vry1 during the reset period 71R, and the resetting circuit 61 of the X driver circuit 60 applies, to the displaying electrodes X1 to Xn, the predetermined voltage Vrx1 in a predetermined positive direction similarly to the voltage Vrx1 during the address period 71R of the subfield SF1. During this period 72R, the addressing electrodes A1 to Am are kept, by the resetting circuit 69, at the voltage Vra2 in the positive direction that is higher by a predetermined voltage difference ΔVa (e.g., 10V) than the voltage Vra1 of the ground potential GND.

During the address period 72A, the scanning circuit 66 applies the scanning pulse voltage Vay1 to the displaying electrodes Y1 to Yn one after another, while the address circuit 70 applies, to the addressing electrodes A1 to Am one after another in accordance with the subfield data Dsf, an addressing voltage Vaa2 in the positive direction that is higher by the predetermined voltage difference ΔVa than the addressing voltage Vaa1 during the address period 71A, and the addressing electrodes of the unselected cells are kept at the potential Vra2. During this period 72A, by the auxiliary circuit 66, the displaying electrodes X1 to Xn are kept at the potential Vax1 that is equal to that during the address period 71A.

During the sustain period 72S, similarly to the sustain period 71S, in a conventional manner, the sustaining pulse voltages Vsx and Vsy are applied alternately to the X electrodes and the Y electrodes, respectively, and the addressing electrodes A1 to Am are kept at the ground potential GND.

Similarly, during each of the reset periods 73R to 78R and the address periods 73A to 78A of the third to eighth subfields SF3 to SF8, each of the resetting circuit 69 and the addressing circuit 70 of the A driver circuit 68 apply, to the addressing electrodes A1 to An, a predetermined voltage in the positive direction that is higher by the predetermined voltage difference ΔVa than the address voltages during the reset period and the address period of the previous subfield. Thus, during the reset period 78R and the address period 78A, they apply, to the addressing electrodes A1 to An, a predetermined potential Vra8 in the positive direction and the addressing pulse voltage Vaa8 that are higher by the predetermined voltage difference ΔVa than the voltages in the previous subfield. In the third to eighth subfields SF3 to SF8, other voltages to be applied to the displaying electrodes X1 to Xn, and Y1 to Yn are the same as those for the subfield SF2, and hence are not described again.

Referring to FIG. 9, during the reset period 72R of the second subfield SF2, by applying the potential difference (Vra2−Vry1) having the maximum potential difference larger than the potential difference (0−Vryn) at the time 71RE which is the last portion of the reset period 71R, between the addressing electrodes A1 to Am and the displaying electrodes Y1 to Yn, i.e., by applying the potential Vra2 to the addressing electrodes A1 to Am, the cell voltages ($Vc_{XY}$, $Vc_{AY}$) of the cells unilluminated during the sustain period of the previous field reach the Vt closed curve 80 from a position inside the area 82 along the arrow, then move along the Vt closed curve 80, and reach securely to the corner of coordinates 91 repeating micro-discharges. Thereby, the dispersion of the cell voltages is absorbed. Thus, the cell voltages ($Vc_{XY}$, $Vc_{AY}$) of all the cells move to the corner of coordinates 91. The cell voltages of the cells selected during the subsequent address period 72A move to the point of coordinates 101, so that a stable addressing discharge is produced. Thus, the cells are illuminated securely during the sustain period. The cell voltages of the unselected cells move into the vicinity of the predetermined point of coordinates 81 at the end of the next sustain period 72S, and then the cell voltages lie in the range of the area 82. Similar operations develop for the third to eighth subfields SF3 to SF8.

Figure 10A:
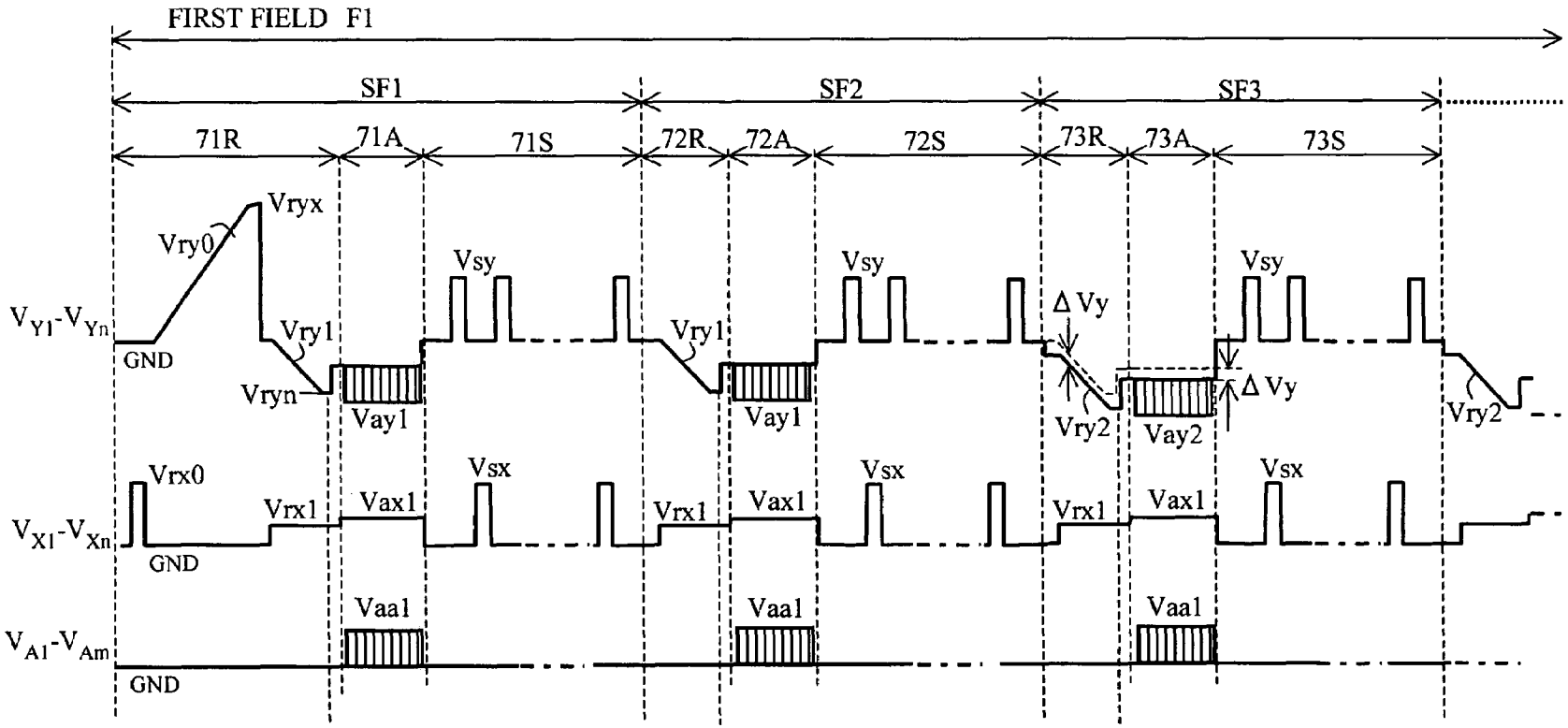
FIGS. 10A and 10B show a time sequence of the PDP driving voltages during the reset periods and the address periods of the respective subfields of two consecutive subfields, in accordance with a fourth embodiment of the invention.
Figure 10B:
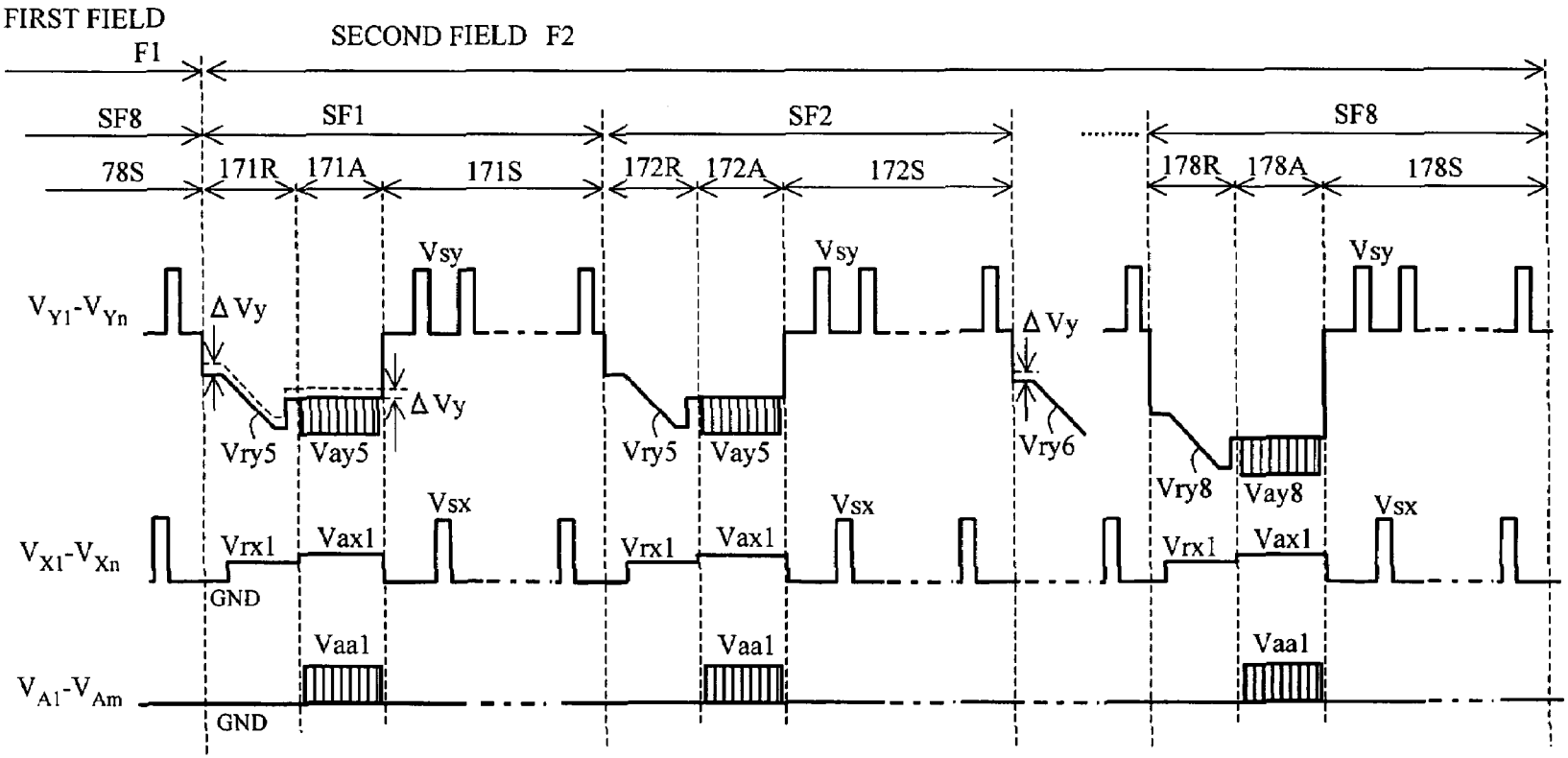

FIGS. 10A and 10B show a modification of the second embodiment of FIG. 5, which is a time sequence of the PDP driving voltages during the reset periods 71R to 78R, and 171R to 178R, and the address periods 71A to 78A, and 171A to 178A of the respective subfields SF1 to SF8 of the first field F1 and the subsequent second field F2, in accordance with a fourth embodiment of the invention. In this embodiment, in the first subfield SF1 of the second field F2, only the minor resetting is performed without any major resetting. In the first field F1 or in odd-numbered fields, the sequence of PDP driving voltages shown in FIG. 10A is used. In the second field F2 following the fist field F1 or in even-numbered fields, the sequence of PDP driving voltages shown in FIG. 10B is used. During the reset periods 71R to 78R, and 171R to 178R, and the address periods 71A to 78A, and 171A to 178A shown in FIGS. 10A and 10B, for every two consecutive subfields, the down-ramping voltage in the negative direction, the scanning voltage and the non-scanning voltage to be applied to the displaying electrodes Y1 to Yn are lowered in the negative direction by the difference ΔVy (e.g., 10V). Other portions of the sequence are the same as the corresponding portions of that shown in FIG. 5. Thus, reduction of the number of the major reset periods allows expansion of the length of the sustain period, to thereby improve the quality of display.

Similarly, the first embodiment of FIG. 4 may be modified, so that, in the first subfield SF1 of the second field F2, only minor resetting may be performed without any major resetting. In this case, during the reset periods and the address periods in sixteen subfields of the two consecutive fields F1 and F2, for every two subfields, the voltages (Vrx2 to Vrx8, and Vax2 to Vax8) in the positive direction to be applied to the displaying electrodes X1 to Xn are raised in the positive direction by the difference ΔVx (e.g., 10V). The other portions of the sequence are the same as the corresponding portions of that shown in FIG. 4.

Similarly, the third embodiment of FIG. 6 may be modified, so that, in the first subfield SF1 of the second field F2, only minor resetting may be performed without any major resetting. In this case, during the reset and address periods in sixteen subfields of the two consecutive fields F1 and F2, for every two subfields, the voltages in the positive direction and the addressing voltages (Vra2 to Vra8, and Vaa2 to Vaa8) to be applied to the addressing electrodes A1 to Am are raised in the positive direction by the difference ΔVa (e.g., 10V). The other portions of the sequence are the same as the corresponding portions of that shown in FIG. 6.

Figure 11:
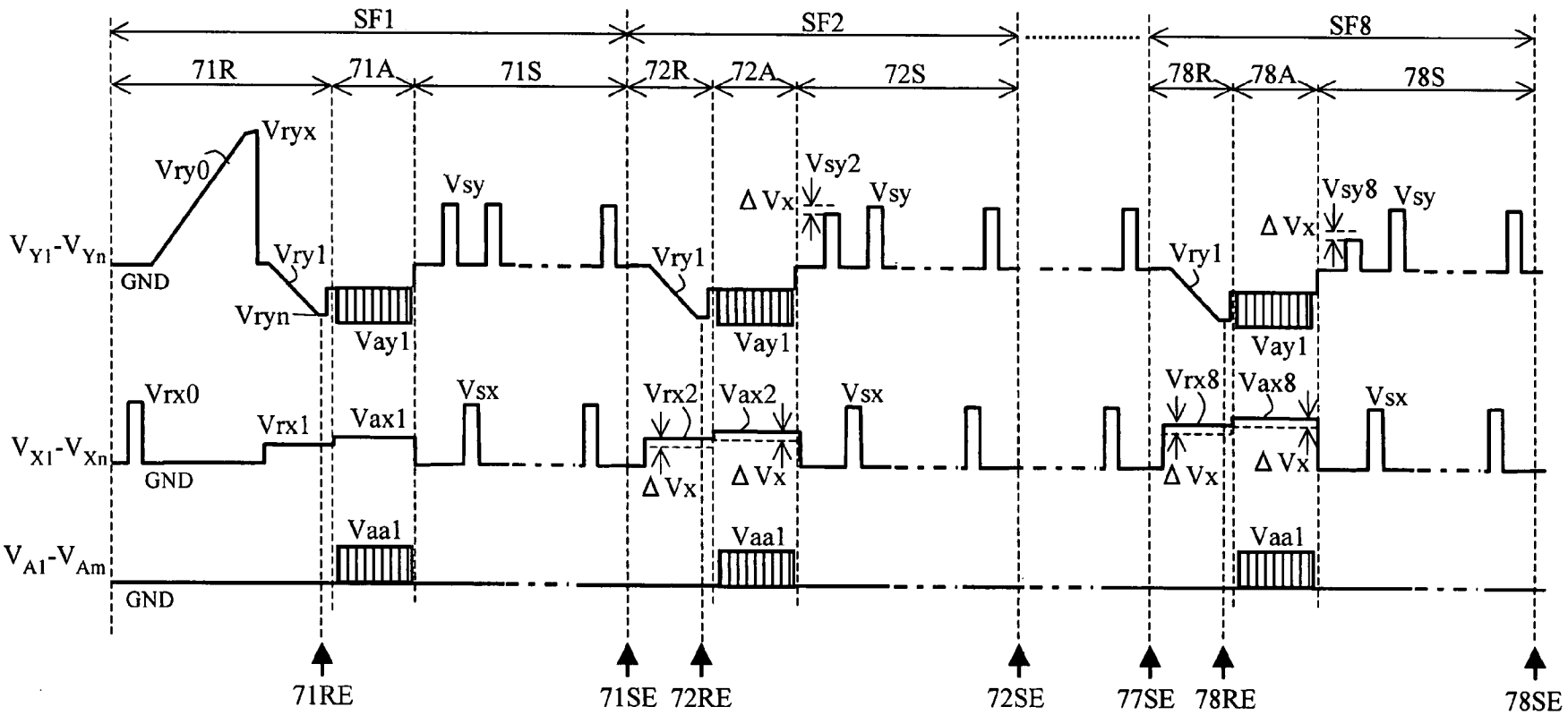
FIG. 11 shows a time sequence of the PDP driving voltages during the reset periods and the address periods of the respective subfields, in accordance with a fifth embodiment of the invention.

FIG. 11 shows a modification of the first embodiment of FIG. 4, which is a time sequence of the PDP driving voltages during the reset periods 71R to 78R, and the address periods 71A to 78A of the respective subfields SF1 to SF8, in accordance with a fifth embodiment of the invention. As described above, during the minor reset periods 72R to 78R and the address periods 72A to 78A, the flat voltages (Vax2 to Vax8) in the positive direction to be applied to the displaying electrodes X1 to Xn are raised gradually for every subfield in the positive direction by the difference ΔVx (e.g., 10V). In this case, for the illuminated cells, the discharge voltage produced by the first sustaining voltage Vsy applied to the displaying electrodes Y1 to Yn during the sustain periods 71S to 78S is raised in the positive direction by the difference ΔVx gradually for every field. On the other hand, in this embodiment, in order to compensate this gradual voltage raise, during the sustain periods 72S to 78S, the first, respective sustaining voltages Vsy2 to Vsy8 applied to the displaying electrodes Y1 to Yn are lowered by the difference ΔVx (e.g., 10V) gradually for every subfield. This allows stable discharges in all of the reset, address and sustain periods.

In the embodiments described above, a positive up-ramping, resetting voltage, the absolute of which is larger than the absolute of the negative down-ramping, resetting voltage for each of the other subfields SF2 to SF 8, is applied during the major reset period 71R of the first subfield SF1. However, a high pulse-form resetting voltage in the positive direction may be used rather than the up-ramping, resetting voltage. The major resetting may be performed in one subfield SF1 for every three or more fields. Furthermore, in the minor resetting for the last several subfields, at least the last one subfield, of the plurality of subfields SF1 to SF8 forming one field, the potential to be applied to the displaying electrodes X1 to Xn, the height of the negative down-ramping voltage to be applied to the displaying electrodes Y1 to Yn, or the potential to be applied to the addressing electrodes A1 to Am may be raised by the predetermined voltage difference ΔVx, −ΔVy or ΔVa relative to the previous subfield.

Alternatively, two or three of the first, second and third embodiments may be combined, so as to stepwise vary the voltages to be applied to the displaying electrodes X1 to Xn, the displaying electrodes Y1 to Yn, and/or the addressing electrodes A1 to Am, during the reset and address periods of the subfields SF2 to SF8.

The above-described embodiments are only typical examples, and their combination, modifications and variations are apparent to those skilled in the art. It should be noted that those skilled in the art can make various modifications to the above-described embodiments without departing from the principle of the invention and the accompanying claims.

What is claimed is:

1. In a plasma display panel (PDP), a method comprising driving said PDP for displaying a picture on said PDP by dividing a field into a plurality of subfields, said PDP comprising a first plurality of electrodes arranged in a first direction, a second plurality of electrodes paired with said first plurality of respective electrodes and arranged in said first direction, and a third plurality of electrodes arranged in a second direction so as to cross over said first direction, said PDP further comprising a plurality of cells at crossing portions between said first and second pluralities of electrodes and said third plurality of electrodes, said method further comprising:

resetting for adjusting charges in the cells in the subfields, the resetting for adjusting charges comprising applying voltage waveforms to said electrodes so that the potential difference applied between said second plurality of electrodes and at least one of said first plurality of electrodes and said third plurality of electrodes for the resetting for adjusting charges in a predetermined one of the subfields is larger than the potential difference applied therebetween for the resetting for adjusting charges in a previous subfield.

2. The method of claim 1, wherein the resetting further comprises applying a ramping potential to the first plurality of electrodes.

3. The method of claim 1, wherein the resetting further comprises producing discharge for forming charges in the cells in at least one of said subfields before producing discharge for adjusting the charges in the cells.

4. In a PDP, a method comprising driving said PDP for displaying a picture on said PDP by dividing a field into a plurality of subfields, said PDP comprising a first plurality of electrodes arranged in a first direction, a second plurality of electrodes paired with said first plurality of respective electrodes and arranged in said first direction, and a third plurality of electrodes arranged in a second direction so as to cross over said first direction, said PDP further comprising a plurality of cells at crossing portions between said first and second pluralities of electrodes and said third plurality of electrodes, said method comprising:

resetting for adjusting charges in the cells in the subfields, the resetting for adjusting charges comprising applying voltage waveforms to said electrodes so that the potential difference applied between said second plurality of electrodes and at least one of said first plurality of electrodes and said third plurality of electrodes for the resetting for adjusting charges in a predetermined one of the subfields is larger than the potential difference applied therebetween for the resetting for adjusting charges in a previous subfield, wherein the resetting further comprises producing discharge for forming charges in the cells in a predetermined subfield within a plurality of fields before producing discharge for adjusting the charges in the cells.

5. The method of claim 4, wherein the resetting further comprises applying a ramping potential to the first plurality of electrodes.

* * * * *